US008531296B2

(12) United States Patent
Wehrenberg

(10) Patent No.: US 8,531,296 B2
(45) **Date of Patent: *Sep. 10, 2013**

(54) ACCELERATION-BASED THEFT DETECTION SYSTEM FOR PORTABLE ELECTRONIC DEVICES

(75) Inventor: Paul J. Wehrenberg, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/493,746

(22) Filed: Jun. 11, 2012

(65) Prior Publication Data

US 2012/0278907 A1 Nov. 1, 2012

Related U.S. Application Data

(60) Continuation of application No. 13/152,210, filed on Jun. 2, 2011, now Pat. No. 8,217,792, which is a continuation of application No. 12/469,561, filed on May 20, 2009, now Pat. No. 7,986,233, which is a continuation of application No. 11/681,664, filed on Mar. 2, 2007, now Pat. No. 7,548,161, which is a division of application No. 10/791,495, filed on Mar. 1, 2004, now Pat. No. 7,218,226.

(51) Int. Cl.
*G08B 13/14* (2006.01)

(52) U.S. Cl.
USPC ... 340/571; 340/539.11; 340/541; 340/568.1; 340/669

(58) Field of Classification Search
USPC ..... 340/571, 539.11, 540, 541, 568.1, 340/669; 707/2, 7, 9, 10; 726/2, 3, 34, 35
See application file for complete search history.

(56) References Cited

U.S. PATENT DOCUMENTS

| | | | | |
|---|---|---|---|---|
| 4,337,462 | A | 6/1982 | Lemelson | |
| 4,471,343 | A | 9/1984 | Lemelson | |
| 5,317,304 | A | 5/1994 | Choi | |
| 5,574,429 | A * | 11/1996 | Streeter | 340/571 |
| 5,757,271 | A | 5/1998 | Andrews | |
| 5,760,690 | A | 6/1998 | French | |
| 5,831,530 | A | 11/1998 | Lace et al. | |
| 5,963,131 | A | 10/1999 | D'Angelo et al. | |
| 6,087,937 | A * | 7/2000 | McCarthy | 340/567 |
| 6,133,830 | A | 10/2000 | D'Angelo et al. | |
| 6,172,607 | B1 | 1/2001 | McDonald | |
| 6,294,995 | B1 | 9/2001 | Patterson | |
| 6,359,560 | B1 | 3/2002 | Budge et al. | |
| 6,552,652 | B2 | 4/2003 | Beken | |
| 6,559,767 | B2 | 5/2003 | Huang | |

(Continued)

FOREIGN PATENT DOCUMENTS

WO WO 00/39602 7/2000

*Primary Examiner* — Hung T. Nguyen
(74) *Attorney, Agent, or Firm* — David C. Kellogg

(57) ABSTRACT

A theft prevention system for protecting portable electronic devices is disclosed. An acceleration sensor detects the acceleration of a portable electronic device, and a controller analyzes this acceleration to determine whether a theft condition is present. If so, an alarm can be initiated. The theft prevention system can include a filter for attenuating irrelevant acceleration frequencies and isolating those representative of theft, and comparison hardware/software for determining whether the detected acceleration matches a known acceleration profile characteristic of theft. Various parameters of the theft prevention system can also be set by a user through mechanisms such as a graphical user interface.

16 Claims, 5 Drawing Sheets

(56) References Cited

U.S. PATENT DOCUMENTS

| | | | | |
|---|---|---|---|---|
| 6,721,738 | B2 | 4/2004 | Verplaetse et al. | |
| 6,768,066 | B2 | 7/2004 | Wehrenberg | |
| 6,940,407 | B2 | 9/2005 | Miranda-Knapp et al. | |
| 6,970,095 | B1 | 11/2005 | Lee et al. | |
| 7,260,835 | B2 * | 8/2007 | Bajikar | 726/4 |
| 7,518,510 | B2 | 4/2009 | Kojo | |
| 2004/0123161 | A1 * | 6/2004 | Harada et al. | 713/202 |
| 2004/0252397 | A1 | 12/2004 | Hodge et al. | |
| 2006/0107822 | A1 | 5/2006 | Bowen | |

* cited by examiner

ACCELERATION-BASED THEFT DETECTION SYSTEM FOR PORTABLE ELECTRONIC DEVICES

CROSS REFERENCE TO RELATED APPLICATION

This application is a Continuation application of U.S. patent application Ser. No. 13/152,210 filed Jun. 2, 2011, now U.S. Pat. No. 8,217,792 issued Jul. 10, 2012, entitled "ACCELERATION-BASED THEFT DETECTION SYSTEM FOR PORTABLE ELECTRONIC DEVICES", which is a Continuation application of U.S. patent application Ser. No. 12/469,561 filed May 20, 2009, now U.S. Pat. No. 7,986, 233 issued Jul. 26, 2011, entitled "ACCELERATION-BASED THEFT DETECTION SYSTEM FOR PORTABLE ELECTRONIC DEVICES"; which is a Continuation application of U.S. patent application Ser. No. 11/681,664 filed Mar. 2, 2007, now U.S. Pat. No. 7,548,161 issued Jun. 16, 2009, entitled "ACCELERATION-BASED THEFT DETECTION SYSTEM FOR PORTABLE ELECTRONIC DEVICES"; which is a Divisional application of U.S. patent application Ser. No. 10/791,495 filed Mar. 1, 2004, now U.S. Pat. No. 7,218,226 issued May 15, 2007, entitled "ACCELERATION-BASED THEFT DETECTION SYSTEM FOR PORTABLE ELECTRONIC DEVICES", all of which are incorporated herein by reference in their entirety for all purposes.

BRIEF DESCRIPTION OF THE INVENTION

This invention relates generally to portable electronic devices. More specifically, this invention relates to theft detection systems for portable electronic devices.

BACKGROUND OF THE INVENTION

The drive toward miniaturization of electronics has resulted in computer-based systems that are becoming much more portable. Current portable electronic devices such as laptop computers, hand-held devices such as cellular telephones and personal media devices, such as the iPod™ from Apple Computer, Inc., and even devices such as compact disc players, are sufficiently compact and lightweight as to make them easily movable. Unfortunately, such ease of transport also implies ease of theft. While the rightful owner of a portable electronic device may conveniently transport it almost anywhere, so can a thief.

One current anti-theft system is a simple mechanical lock that attaches to the housing of a device, with a cable that wraps around other objects so as to affix the portable device to these objects. In this manner, portable electronic devices can be effectively tethered to nearby fixtures, making theft difficult. However, such systems suffer from drawbacks. For instance, users are forced to carry around a bulky cable and lock, thus somewhat defeating the purpose of portable electronic devices. Also, users may sometimes wish to leave their devices in areas where there is no convenient fixture to tether to.

It is therefore desirable to develop a theft detection system for portable electronic devices. It is further desirable to develop a theft detection system that does not require the use of additional bulky physical mechanisms, and which is capable of functioning in many different locations.

SUMMARY OF THE INVENTION

Broadly speaking, the invention pertains to detecting theft of portable electronic devices. The acceleration of a device is monitored and processed to determine whether a likely theft condition exists. If so, the various embodiments of the invention then seek to prevent theft by initiating an alarm.

The invention can be implemented in numerous ways, including as a method, system, device, apparatus, or computer readable medium. Several embodiments of the invention are discussed below.

As a theft prevention system for protecting a portable electronic device, one embodiment of the invention comprises an acceleration sensor, an audio output device, and a controller operatively connected with the acceleration sensor and the audio output device, the acceleration sensor, the audio output, and the controller each being proximate to the portable electronic device. The acceleration sensor is configured to sense an acceleration of the portable electronic device and provide an acceleration signal to the controller upon detection of the acceleration. The controller is configured to initiate the production of an alarm signal from the audio output based on the acceleration signal.

As a portable electronic device having a system for protecting against theft, one embodiment of the invention comprises a housing of the portable electronic device, an acceleration sensor proximate to the housing and configured to detect an acceleration of the portable electronic device, and an output device. A controller is operatively connected with the acceleration sensor and configured to initiate the output of an alarm from the output device based on detection of the acceleration by the acceleration sensor.

As a method of protecting a portable electronic device against theft, one embodiment of the invention comprises at least the acts of: monitoring the portable electronic device so as to generate an acceleration signal corresponding to an acceleration of the portable electronic device, the acceleration signal having frequency characteristics of movement of the portable electronic device; filtering the acceleration signal so as to isolate the frequencies characteristic of movement of the device; comparing the acceleration signal to a frequency profile so as to determine a metric measuring a correspondence between the frequency profile and the frequency characteristics of movement of the device; and generating an alarm based upon the metric.

As a computer readable memory including at least computer instructions for directing an electronic system to provide theft protection, one embodiment of the invention comprises at least: a first set of computer instructions to acquire an acceleration signal corresponding to an acceleration of the electronic system, the acceleration signal having frequencies characteristic of movement of the device; a second set of computer instructions to process the acceleration signal so as to isolate the frequencies characteristic of movement of the device; a third set of computer instructions to compare the acceleration signal to a frequency profile so as to determine a metric measuring a correspondence between the frequency profile and the frequencies characteristic of movement of the device; and a fourth set of computer instructions to initiate the production of an alarm based upon the metric.

Other aspects and advantages of the invention will become apparent from the following detailed description taken in conjunction with the accompanying drawings which illustrate, by way of example, the principles of the invention.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF THE INVENTION

In one embodiment of the invention, one or more accelerometers are placed within a portable electronic device to detect acceleration. Any acceleration detected could indicate unauthorized movement of the device, i.e., potential theft. Typically, theft or other large-scale movement of the device results in an acceleration signal having characteristics different from other events such as shock, impact, nearby machinery, etc. The detected acceleration as a function of time is thus analyzed to determine whether it corresponds to such large-scale movement of the device, rather than an innocuous event such as the impact of a book dropped nearby. If so, an alarm is produced in order to alert others to the theft. Further embodiments of the invention include the ability to tune various parameters to the user's liking through a graphical user interface (GUI), and the ability to disable theft detection.

In such a manner, theft detection is accomplished via relatively small and lightweight accelerometers that can be incorporated into the portable electronic device itself, without the need for additional locks and/or cables. Also, as such a system can be contained within the device, it can provide theft protection even in areas where the device cannot be tethered or attached to anything.

Figure 1:
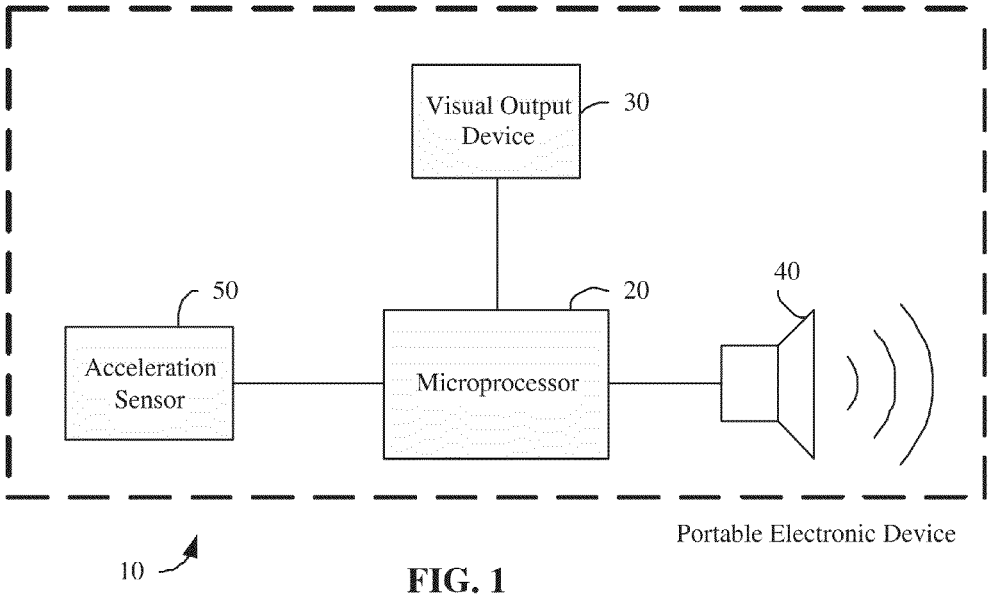
FIG. 1 illustrates a block diagram of a portable electronic device constructed in accordance with an embodiment of the invention.

FIG. 1 illustrates a block diagram of a portable electronic device having a theft detection system constructed in accordance with an embodiment of the invention. A portable electronic device 10 is controlled by a microprocessor 20, which processes instructions and sends information to a visual output device 30, such as a monitor or other mechanism for displaying visual information to a user, and an audio output device 40, such as a speaker. The portable electronic device 10 also includes an acceleration sensor 50 for detecting accelerations undergone by the device 10. The acceleration sensor 50 includes any mechanism for detecting acceleration, such as one or more accelerometers, as well as necessary hardware/software for controlling the accelerometers. The one or more accelerometers can be configured along a different axis.

In operation, the acceleration sensor 50 detects acceleration undergone by the portable electronic device 10, such as when the portable electronic device 10 is picked up by a thief. Upon examining the characteristics of the acceleration and determining that a theft condition is present, the acceleration sensor 50 transmits a theft detection signal to the microprocessor 20, which broadcasts an alarm through the audio output device 40 and/or displays a message across the visual output device 30. In this manner, nearby persons are alerted to the attempted theft and/or the thief is deterred from completing the theft.

In order to more accurately detect theft and to avoid "false alarms" such as the triggering of an alarm when no theft is actually occurring, the invention can include signal conditioning hardware and/or software for filtering out those acceleration signals that do not represent a theft condition. For example, the signal conditioning hardware and/or software should filter out those acceleration signals corresponding to shock or impact.

Figure 2:
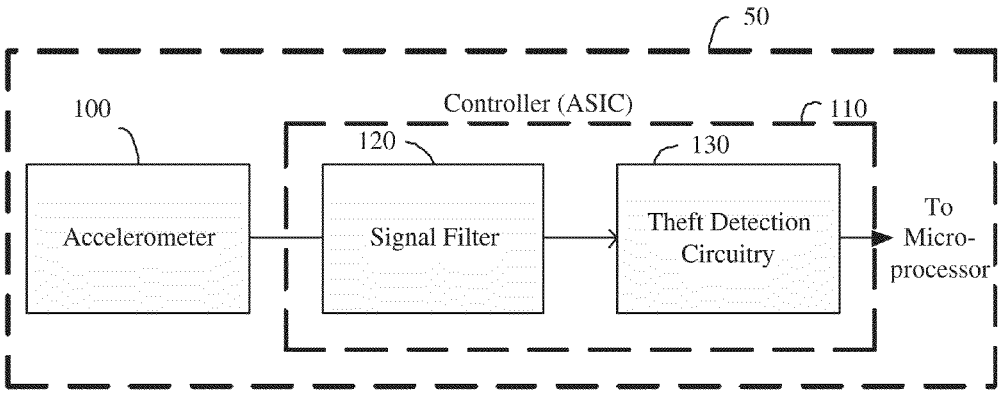
FIG. 2 illustrates a block diagram of a an acceleration sensor constructed in accordance with an embodiment of the invention.

FIG. 2 illustrates a block diagram of the acceleration sensor 50 constructed in accordance with an embodiment of the invention. The acceleration sensor 50 includes accelerometers 100 for detecting acceleration, and a controller 110, which can be an application-specific integrated circuit (ASIC). In this embodiment, the controller 110 includes a signal filter 120 and theft detection circuitry 130. The signal filter 120 is a frequency filter designed to attenuate certain acceleration frequencies and pass others. The theft detection circuitry 130 analyzes the passed frequencies to determine whether a theft condition is present. The acceleration sensor 50 is typically built on a single circuit board, with the accelerometers 100 mounted on the board and electronically connected to an controller 110. The invention includes alternative embodiments, however. For instance, the accelerometers 100 can be mounted on or in the housing of the portable electronic device 10 and remote from an ASIC controller 110. It is also possible for the signal filter 120 and/or the theft detection circuitry 130 to be integrated into or performed by the microprocessor 20, in which case the controller 110 can be considered one module of the microprocessor 20.

The accelerometers 100 are (directly or indirectly) coupled to the housing of the portable electronic portable electronic device 10, where they detect acceleration undergone by the portable electronic device 10. The accelerometers 100 convert this acceleration to an electronic acceleration signal and supply this signal to the controller 110. It is common for the accelerometers 100 to pick up acceleration frequencies characteristic of both theft and other innocuous events. Examples of innocuous events include: the vibration of a car passing by, or someone dropping an object on a table upon which the portable electronic device 10 is placed. As a result, the invention includes systems and methods for filtering out and isolating certain frequencies that tend to be characteristic of theft, i.e. identifying one or more theft conditions, and signaling an alarm accordingly. In this manner, many false alarms are avoided.

It is known that large-scale movements commonly generate lower frequency acceleration signals. For instance, the carrying of a laptop may result in that laptop experiencing accelerations in the range of one to hundreds of Hz. However, events not including transport of the device, such as shock or impact, generate higher frequency signals, typically in the kHz range and above. Thus, the signal filter 120 can implement a low pass filter designed to attenuate such higher shock/impact frequencies, and to pass lower frequencies associated with movements like theft. In this manner, the signal filter 120 would act to isolate lower frequencies for easier detection. The theft detection circuitry 130 can then detect the presence of such lower frequencies and send a theft detection signal to the microprocessor 20 when appropriate.

To further reduce the risk of false alarms, the signal filter 120 and theft detection circuitry 130 can be configured not just as a simple threshold system that signals an alarm based on the detection of frequencies below a certain frequency, but also as a system programmed to detect certain acceleration frequency spectra characteristic of theft. Thus, empirical or theoretical data can be used to determine frequency profiles common to many theft situations, and the controller 110 can be programmed to scan for those particular profiles. For instance, if it is determined that the manual transport of a particular portable electronic device 10 often results in the portable electronic device 10 undergoing accelerations in the range of 1-25 Hz (say, due to the rhythmic movement caused by a thief's walking or running), along with accelerations in the range of 100-200 Hz (perhaps due to quicker changes in direction, jumping, etc.), the signal filter 120 can be designed to pass frequencies only in those ranges. The theft detection circuitry 130 can then send a theft detection signal to the microprocessor 20 only upon detecting frequencies in both ranges.

From the above, it should be clear to those skilled in the art that the theft detection circuitry 130 can be designed to look for any such profile of acceleration frequencies. In this manner, the invention includes the detection of theft through comparing the actual acceleration of a portable electronic device to any predetermined acceleration frequency spectrum, and signaling an alarm accordingly.

Figure 3:
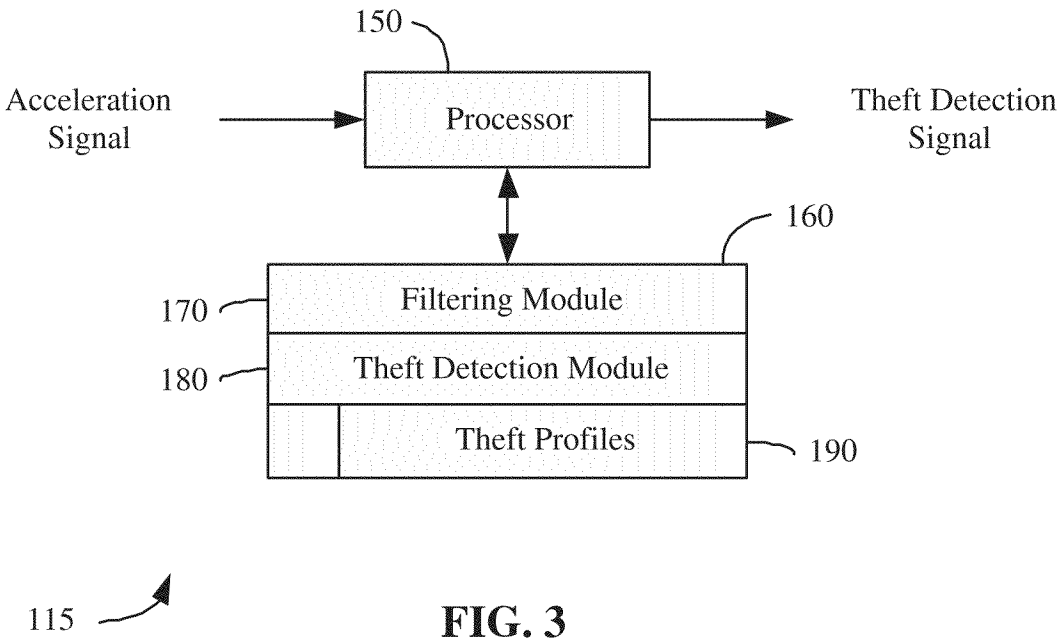
FIG. 3 illustrates an exemplary controller for detecting theft in accordance with an embodiment of the invention.

It should also be apparent to those skilled in the art that the theft detection processes of the controller 110 can be carried out in hardware and/or software configurations. More specifically, the filtering and detection processes can be carried out by either hardware (such as the application-specific circuitry outlined in FIG. 2) or software instructions. While hardware for carrying out the above operations offers many advantages in terms of processing speed and the like, a software configuration can offer added functionality and flexibility. FIG. 3 illustrates an exemplary controller 115 for detecting theft using a software configuration in accordance with an embodiment of the invention. Here, the controller 115 includes a processor 150 in electronic communication with a memory 160 that stores modules containing instructions for carrying out various processes. In this embodiment, the modules include a filtering module 170 containing instructions for filtering acceleration signals, and a theft detection module 180 containing instructions for evaluating the filtered acceleration signal and indicating a theft condition. The theft detection module 180 can include or make use of a set of theft profiles 190 for comparison to the acceleration signal. Such a configuration allows the processor 150 to monitor and receive an acceleration signal from the accelerometers 100, filter the signal, and analyze the filtered signal, such as by comparing it to one or more of the theft profiles 190, to determine whether theft is occurring. As discussed below, a comparison metric can be calculated, either explicitly or implicitly, to determine the degree to which a detected acceleration matches a theft profile. If such comparison indicates theft, the processor 150 then sends out a theft detection signal to the microprocessor 20.

The memory 160 can be a read-only memory, or it can be a re-writable memory. The latter configuration offers advantages in terms of flexibility. For instance, a re-writable memory 160 allows the various modules to be updated periodically, so that advances in filtering techniques or additional theft profiles can be added later. This allows the controller 110 to be upgraded over time, so as to provide better theft protection.

Figure 4:
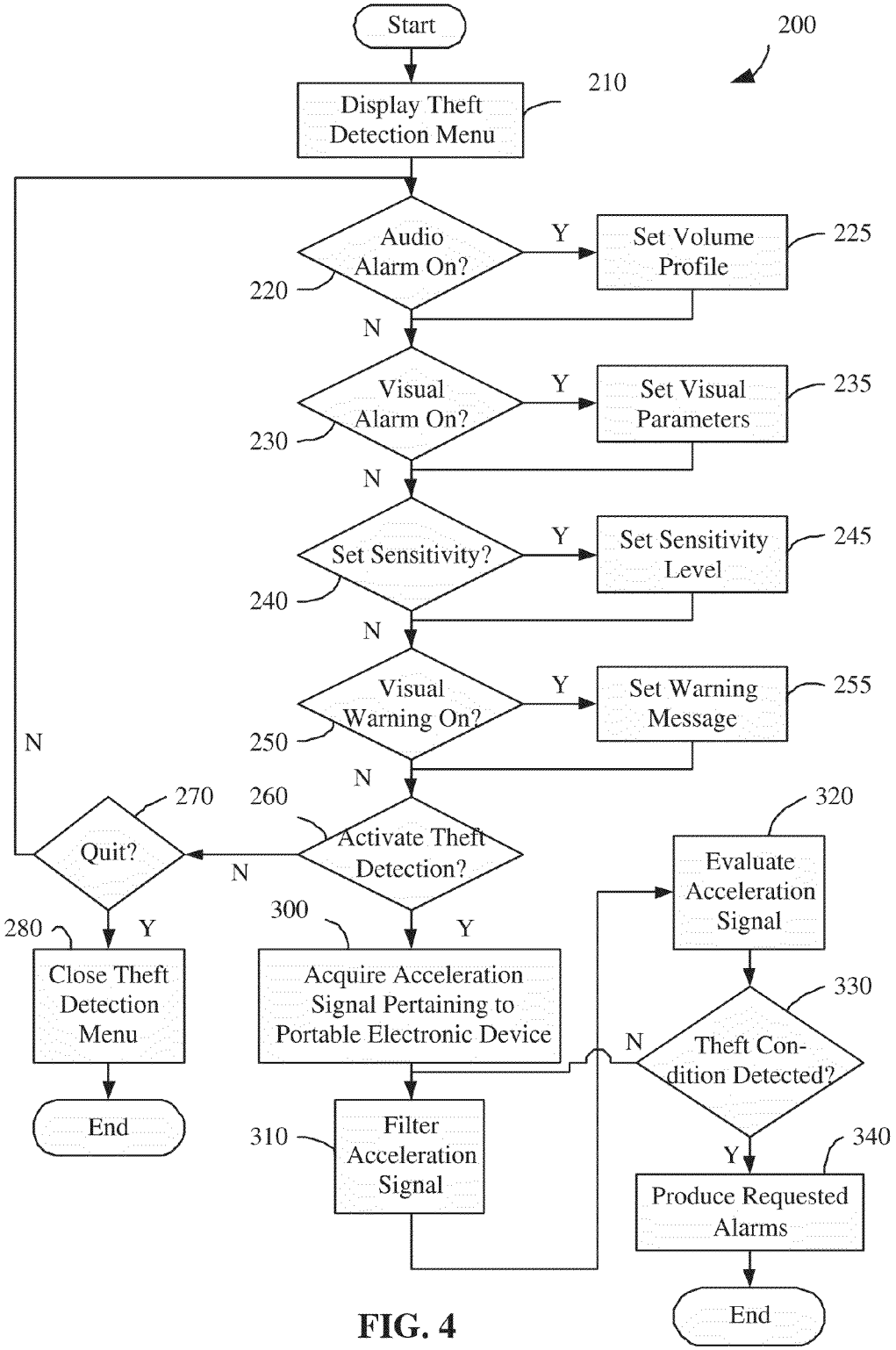
FIG. 4 illustrates a flow diagram of a theft detection process according to an embodiment of the invention.

Attention now turns to a more detailed explanation of the operations taken in detecting theft and signaling an alarm. Accordingly, FIG. 4 illustrates a flow diagram of a theft detection process 200 according to an embodiment of the invention. The Theft detection process 200 is performed by a portable electronic device, such as the portable electronic device 10 illustrated in FIG. 1.

Once it is desired to start the theft detection (process 200), the portable electronic device 10 displays a theft detection menu on the visual output device 30 (block 210). The theft detection menu can be a Graphical User Interface (GUI) that allows users of the portable electronic device 10 to initiate theft detection on demand. The GUI can also include a number of different options allowing a user to configure their desired theft detection in a number of ways. In this embodiment, the GUI allows users to select whether an audio alarm should sound upon detection of theft (block 220). If the user so decides to utilize the audio alarm, the GUI allows them to set the level of its volume, as well as the ramp-up time, described below (block 225). The GUI next allows users to specify whether they desire a visual alarm message (block 230). If so, visual parameters such as the text or font size of the alarm message to be displayed can be set (block 235).

Next, the sensitivity of the alarm can be set (blocks 240, 245). Such a sensitivity setting can take on a number of forms, all within the scope of the invention. For instance, the sensitivity can set a minimum duration during which an acceleration profile matching that of a theft is detected, with higher sensitivities implying a shorter duration before which an alarm is signaled. Alternatively, the sensitivity setting can set a minimum number of discrete frequency values that are detected and that must match a given frequency profile before a theft is indicated. In this manner, sensitivity implies how well a detected acceleration frequency profile matches a known theft acceleration frequency profile. It should be recognized that the invention encompasses these and other definitions of sensitivity.

Next, the GUI can request users to specify whether they desire a visual warning to be displayed on the visual output device 30 (block 250). This visual warning is typically a warning prominently displayed on a monitor or other easily-seen device, which warns potential thieves of the fact that the device 10 currently has an active theft detection system protecting it. As an added measure, the GUI can also allow users to specify their warning message (block 255). Hence, the user can set a custom warning message or select from predetermined warning messages.

After any or all of the above parameters have been set (or even if the user does not set any, instead relying on a set of default parameters), the GUI allows the user to activate the theft detection system (block 260). If it is not desired to activate the system, users are given the option to quit (exit) (block 270), which closes the GUI and ends the program (block 280). Alternatively, if theft detection is activated, the specified warning message (if any) is displayed on the visual output 30 to warn potential thieves, and the acceleration detection and analysis process described above is initiated. Namely, the acceleration of the portable electronic device 10 is monitored to acquire an acceleration signal pertaining to the portable electronic device 10 (block 300). As above, this acceleration signal can pertain a frequency spectrum reflecting the range of frequencies the portable electronic device 10 is subjected to at any given time. The acceleration signal is then filtered to attenuate irrelevant frequencies and isolate those that are more indicative of theft (block 310). This filtered signal, reflecting those frequencies that can indicate theft, is then evaluated to determine the degree to which a theft condition is present (block 320).

In many instances, such evaluation commonly includes the analysis of a metric that indicates the degree to which the acceleration signal matches a known theft condition. Such a metric can be any known measure of correlating two different quantities. For example, the metric can be a simple count of how many detected frequencies match those of a known theft condition, or it can be a complex spectrum analysis reflecting the degree to which the detected spectrum matches a known spectrum of a theft condition. As above, such the metric can be simply a determination of whether certain frequencies are present, or how long they are present. However, it can also be a comparison of the detected acceleration spectrum (or the spectrum as modified by the signal filter 120) to an acceleration spectrum known to be representative of theft. Those of skill will realize that the invention includes the evaluation of any one or more metrics, whether explicitly calculated or implied in a comparison of frequencies, to reliably detect theft conditions from a sensed acceleration.

If a theft condition is detected (block 330), such as when the metric exceeds a certain predetermined value, the a theft detection signal is output to the microprocessor 20 indicating a theft is occurring. Upon receipt of a theft detection signal, the microprocessor 20 triggers the audio output device 40 to sound an audible alarm, and/or the visual output device 30 to flash a visual alarm message (block 340). As above, various parameters of the audio and visual alarms can be specified beforehand via the GUI. Once a theft is detected and an alarm is sounded, the theft detection process 200 ends.

Many portable electronic devices 10 are capable of entering a sleep mode during periods of inactivity. Such a sleep mode commonly involves halting or reducing the operations of the microprocessor 20 in order to conserve electrical power. However, for optimal protection of the device 10, theft detection should continue even during sleep mode. The acceleration sensor 50 is thus configured to operate independent of the microprocessor 20. If a theft condition is detected while the microprocessor 20 is in sleep mode, the theft detection circuitry 130 transmits a theft detection signal as in step 330, preceded by a signal designed to wake the microprocessor 20 from sleep mode (alternatively, the microprocessor 20 can be programmed to wake from sleep mode upon receipt of the theft detection signal itself). In this manner, the invention ensures that the device 10 can conserve power while still maintaining protection against theft.

Figure 5:
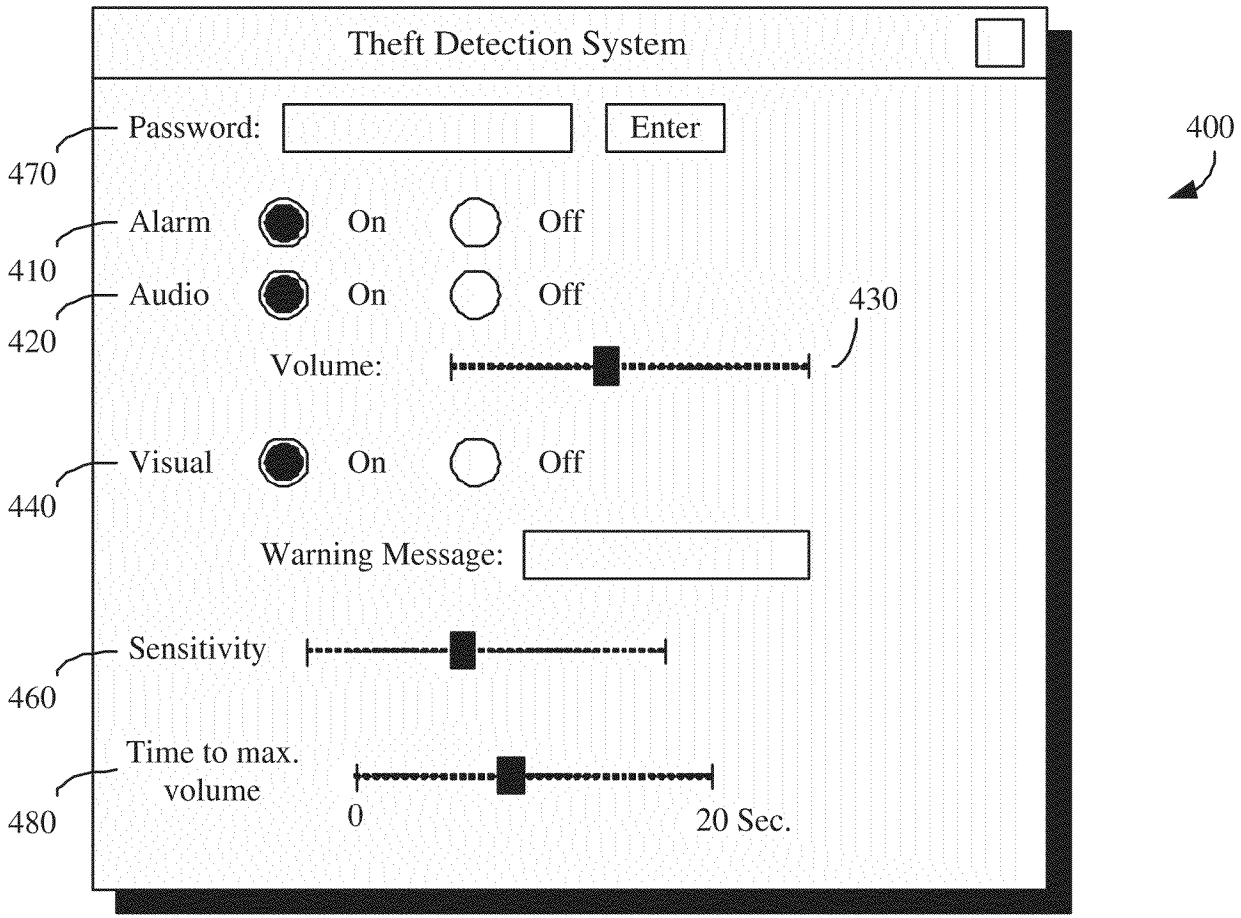
FIG. 5 illustrates a graphical user interface for configuring of a theft detection system in accordance with an embodiment of the invention.

FIG. 5 illustrates a graphical user interface (GUI) 400 for configuring a theft detection system in accordance with an embodiment of the invention. The GUI 400 provides a convenient and user-friendly mechanism for specifying various theft detection parameters. In this example, the GUI 400 offers users the option of initiating theft detection 410 and, when theft detection is desired, whether an audible alarm 420 and/or a visual alarm 440 are to be utilized. If such alarms are desired, the user can also specify the maximum alarm volume 430 and/or warning message 450 desired. As discussed above, sensitivity 460 of the alarm can also be specified. For example, the audio volume 430 and the sensitivity 460 can be controlled by slider bars such as shown in FIG. 5. Also capable of being specified is the time to maximum volume 480, which sets a time period in which the alarm volume ramps up from a lower volume to the specified maximum volume 430. This ramp-up time allows users who accidentally set off the alarm to disable it before it becomes annoying to those nearby. Finally, if it is desired to halt theft detection, such as when the rightful owner returns to his or her device 10 and wishes to carry it somewhere without an alarm going off, the GUI 400 provides a password box 470 for the user to turn off theft detection.

Figure 6:
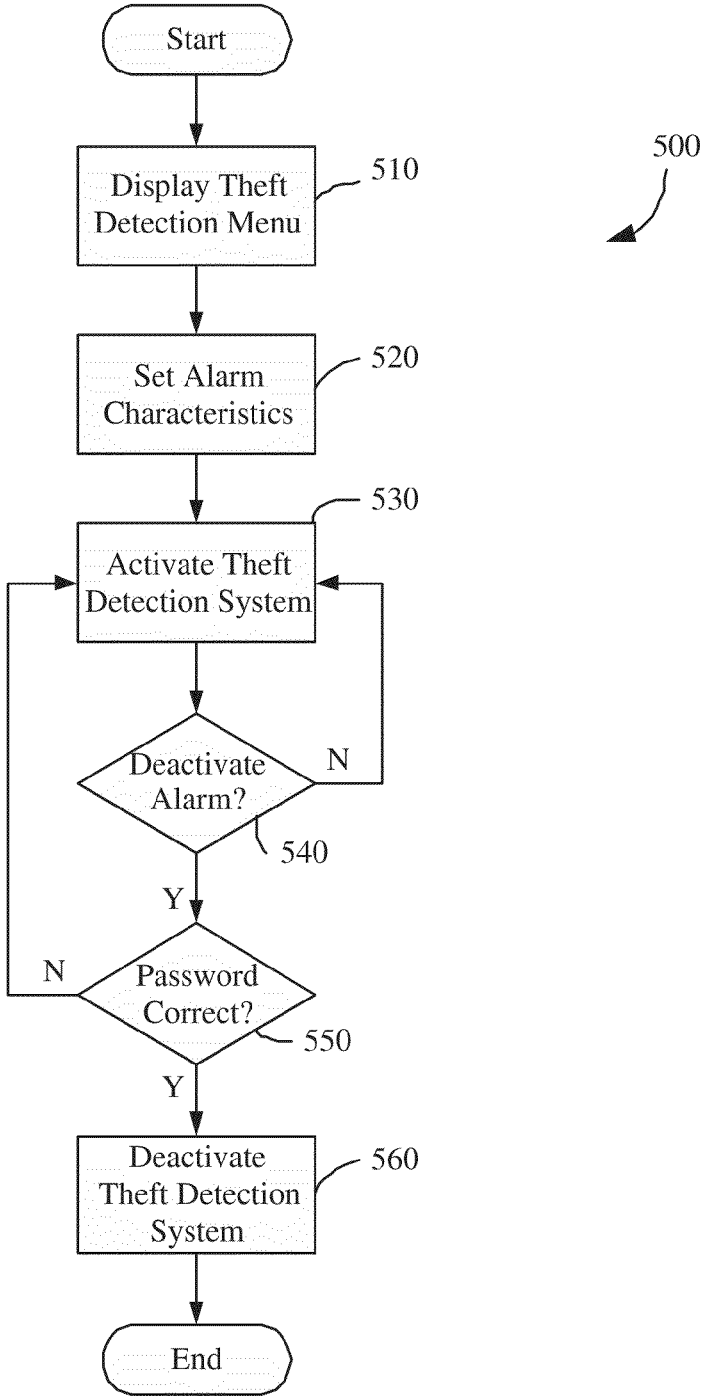
FIG. 6 illustrates a flow diagram of a process according to an embodiment of the invention.

FIG. 6 illustrates a flow diagram of a deactivation process 600 according to an embodiment of the invention. The deactivation process 600 disables the theft detection. As above, once the GUI 400 is displayed (block 510) and the user sets the appropriate alarm characteristics (block 520), theft detection is initiated (block 530). For instance, a user of a laptop computer may desire to leave the computer for a period of time. In such case, the user pulls up the GUI 400, sets the alarm characteristics as desired, and initiates theft detection. When the user later returns to the computer, the user can deactivate the alarm (block 540) by entering the correct password. For example, the user can enter a password into the password box 470. If the password is correct (block 550), the deactivation process 400 halts theft detection (step 560), allowing users to resume normal operation of the portable electronic device 10.

The foregoing description, for purposes of explanation, used specific nomenclature to provide a thorough understanding of the invention. However, it will be apparent to one skilled in the art that the specific details are not required in order to practice the invention. In other instances, well-known circuits and devices are shown in block diagram form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. For example, the controller 110, 115 or the microprocessor 20 can be configured to filter or modify acceleration signals, and evaluate or compare them to any profile, as appropriate in order to reliably detect theft conditions. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A method for providing theft protection for an electronic device by a theft protection sub-system, comprising:

operating the theft protection sub-system independently of a processor controlling the electronic device;

by the theft detection sub-system independent of the processor, detecting an acceleration of the electronic device;

generating a theft detection signal only when the acceleration is indicative of a known theft condition;

sending the theft detection signal to the processor, wherein the processor is arranged to enter a sleep mode to conserve electrical power consumption by the electronic device and the theft protection sub-system is operable when the processor is in the sleep mode and wherein generating the theft detection signal comprises generating the theft detection signal while the processor is in the sleep mode; and prior to sending the theft detection signal to the processor, using the theft detection sub-system to generate and send a wake up signal to the processor.

2. The method defined in claim 1 further comprising:

disabling at least some operations of the electronic device when the theft protection sub-system generates the theft detection signal.

3. The method defined in claim 1 wherein the electronic device comprises a laptop computer.

4. The method defined in claim 1 wherein the electronic device comprises a portable device.

5. The method defined in claim 1 wherein the electronic device comprises a cellular telephone.

6. The method defined in claim 1 further comprising:

generating an audible alarm using an audio output device in the electronic device in response to the theft detection signal.

7. The method defined in claim 1 further comprising:

displaying a visual alarm message using a display in the electronic device in response to the theft detection signal.

8. An electronic device comprising:

a processor operable to control the electronic device;

an accelerometer operable to generate acceleration signals indicative of movement of the electronic device;

a theft protection system configured to operate independently from the processor, wherein the theft protection system is operable to determine whether a theft condition is present based at least partly on the acceleration signals from the accelerometer, wherein the processor is operable to enter a sleep mode to conserve electrical power, wherein the theft protection system is operable even when the processor is in the sleep mode, wherein the theft protection system is operable to send a theft detection signal to the processor when the theft protection system determines that the theft condition is present, and wherein, when the theft protection system determines that the theft condition is present while the processor is in the sleep mode, the theft protection system is operable to send a wake up signal to the processor prior to sending the theft detection signal to the processor.

9. The electronic device defined in claim 8 wherein the theft protection system is operable to disable at least some operations of the electronic device when the theft protection system determines that the theft condition is present.

10. The electronic device defined in claim 8 wherein the electronic device comprises a laptop computer.

11. The electronic device defined in claim 8 wherein the electronic device comprises a portable device.

12. The electronic device defined in claim 8 wherein the electronic device comprises a cellular telephone.

13. An electronic device comprising:

a processor;

an accelerometer operable to generate acceleration signals indicative of movement of the electronic device;

a theft protection system, wherein the theft protection system is operable to determine whether a theft condition is present based at least partly on the acceleration signals from the accelerometer, wherein the processor is operable to enter a sleep mode to conserve electrical power, wherein the theft protection system is operable even when the processor is in the sleep mode, wherein the theft protection system is operable to send a theft detection signal to the processor when the theft protection system determines that the theft condition is present, and wherein the theft protection system is operable to detect the theft condition while the processor is in the sleep mode and operable to send a wake up signal to the processor prior to sending the theft detection signal to the processor.

14. The electronic device defined in claim 13 wherein the electronic device comprises a laptop computer.

15. The electronic device defined in claim 13 wherein the electronic device comprises a portable device.

16. The electronic device defined in claim 13 wherein the electronic device comprises a cellular telephone.

* * * * *